US006595125B2

(12) United States Patent
Kawado et al.

(10) Patent No.: US 6,595,125 B2
(45) Date of Patent: Jul. 22, 2003

(54) SLIDE DRIVE UNIT OF A PRESS

(75) Inventors: Akio Kawado, Komatsu (JP); Shigeru Nakayama, Neagari-machi (JP)

(73) Assignee: Komatsu, Ltd. (JP)

( * ) Notice: Subject to any disclaimer, the term of this patent is extended or adjusted under 35 U.S.C. 154(b) by 0 days.

(21) Appl. No.: 10/127,713

(22) Filed: Apr. 23, 2002

(65) Prior Publication Data

US 2002/0157445 A1 Oct. 31, 2002

(30) Foreign Application Priority Data

Apr. 25, 2001 (JP) ..... 2001-127488

(51) Int. Cl.[7] ..... B30B 1/06; B30B 1/10

(52) U.S. Cl. ..... 100/282; 100/283; 100/286; 72/452.5

(58) Field of Search ..... 100/282, 283, 100/285, 257, 272, 286, 233; 72/452.4, 452.5, 450, 446; 74/38, 40; 83/530, 632

(56) References Cited

U.S. PATENT DOCUMENTS 2,688,296 A * 9/1954 Danly et al. ..... 72/417
3,695,090 A * 10/1972 Kita ..... 72/450
3,772,986 A * 11/1973 Kawagoshi et al. ..... 100/282

FOREIGN PATENT DOCUMENTS

JP 47-7835 3/1972

* cited by examiner

*Primary Examiner*—Allen Ostrager
*Assistant Examiner*—JImmy T Nguyen
(74) *Attorney, Agent, or Firm*—Rader, Fishman & Grauer PLLC

(57) ABSTRACT

Angle (θ) formed by straight lines (A, B) connecting a fixed shaft (23) and two connecting shafts (24, 25) of a triaxial link (16) of a slide drive unit (10) is set acute, so that position of a slide at any crank angle can be made higher than a conventional arrangement throughout the entire slide motion and the slide can be located above a height necessary for conveying a workpiece for a longer time per the same cycle speed, thereby driving a transfer feeder with sufficient time, allowing secure conveyance of the workpiece while improving productivity of a press and avoiding restriction of design.

2 Claims, 5 Drawing Sheets

SLIDE DRIVE UNIT OF A PRESS

BACKGROUND OF THE INVENTION

1. Field of the Invention

The present invention relates to a slide drive unit of a press, which more specifically relates to a slide drive unit with improved slide motion.

2. Description of Related Art

Conventionally, a slide drive unit of a link press slowly lowers and quickly raises a slide, an example of which has been shown in Japanese Examined Patent Publication No. Sho 47-7835.

The slide drive unit has: a main gear rotated around a main gear supporting fixed shaft; a double-arm link and a single-arm link rotatably fitted to an eccentric drum integrated with the main gear; a connecting rod connected to an end of the double-arm link; an intermediate link connected to the other end of the double-arm link; and a triaxial link rotated around another fixed shaft parallel to the main gear supporting fixed shaft and connected to the intermediate link and the single-arm link, the fixed shaft and the other two shafts (connected with the intermediate link and the single-arm link) of the triaxial link being located approximately on a straight line extending approximately perpendicular with the fixed shaft at the center thereof.

Since deep-drawing formability is attached so much importance in the slide drive unit that slide motion in lowering the slide becomes too gentle, the difference between crank angle where the slide is located at a height above the bottom dead center and crank angle at the bottom dead center is substantially great. Accordingly, the slide reaches at a low position at an early stage before the bottom dead center.

Incidentally, a transfer press is ordinarily continuously driven without stopping at the top dead center per one operation cycle as in a single press and a tandem press, and SPM (cycle per a minute) tends to increase for improving productivity, where the time per one cycle may be two to three seconds.

When the above-described slide drive unit is applied to the transfer press, since the slide reaches to the low position at a too early stage, the time reserved for conveyance of a workpiece with a transfer bar is further shortened and feed motion of the transfer bar is strictly limited. Accordingly, high-speed drive of the transfer feeder is required.

However, when the transfer feeder is driven at a high speed without changing the feed motion, great acceleration and deceleration is applied on the transfer bar, thereby easily causing misfeed of a workpiece. Therefore, there is inherent limit for increasing the speed of the transfer feeder. Though a workpiece may be securely conveyed while causing small acceleration and deceleration on the transfer bar by adjusting the feed motion, the conveyed workpiece is likely to interfere with the die in this arrangement, so that die design becomes difficult.

In order to reduce acceleration and deceleration generated on the transfer bar while overcoming the restriction on the die to improve the productivity of a press, longer time has to be retained for conveying the workpiece, and slide motion therefor has been desired.

SUMMARY OF THE INVENTION

An object of the present invention is to achieve a slide motion of a slide drive unit of a press capable of improving the productivity of a press and prolonging the time for conveying a workpiece.

A slide drive unit of a press according to an aspect of the present invention includes: a main gear; a double-arm link and a single-arm link rotatably fitted to an eccentric drum integrated with the main gear; a connecting rod connected to one end of the double-arm link; an intermediate link connected to the other end of the double-arm link; and a triaxial link rotated around a fixed shaft parallel to a main gear supporting fixed shaft for supporting the main gear, the triaxial link being connected with the intermediate link and the single-arm link, in which an angle formed by a straight line connecting a connecting shaft of the intermediate link with the fixed shaft of the triaxial link and another straight line connecting the connecting shaft of the single-arm link and the triaxial link and the fixed shaft of the triaxial link is acute.

According to the above aspect of the present invention, the angle formed by straight lines connecting a fixed shaft and two connecting shafts of a triaxial link is set acute, so that position of a slide at any crank angle can be made higher than a conventional arrangement throughout the entire slide motion, where the time for, for instance, the slide to be lowered from the top dead center to a predetermined position can be lengthened. Accordingly, the slide can be located above a height necessary for conveying a workpiece for a longer time per the same SPM, thereby driving a transfer feeder with sufficient time. Therefore, the workpiece can be securely conveyed without causing great acceleration and deceleration to a transfer bar etc. and restricting die design even when the productivity of the press is enhanced.

In the above arrangement, one end of the connecting rod may preferably be connected to the double-arm link and the other end of the connecting rod may preferably be connected to the slide or a plunger perpendicularly reciprocating between the connecting rod and the slide, and wherein horizontal position of a center of a shaft connecting the other end of the connecting rod may preferably be shifted to a side opposite to the fixed shaft of the triaxial link relative to a shaft center of the main gear supporting fixed shaft. With the above arrangement, only compressive force is applied to the single-arm link or the intermediate link while driving the slide, so that shaky movement at the connecting shaft of the respective links caused by switching force such as alternately applied compressive force and tensile force is unlikely to be caused, thereby improving processing accuracy.

DETAILED DESCRIPTION OF PREFERRED EMBODIMENT(S)

An embodiment of the present invention will be described below with reference to attached drawings.

Figure 1:
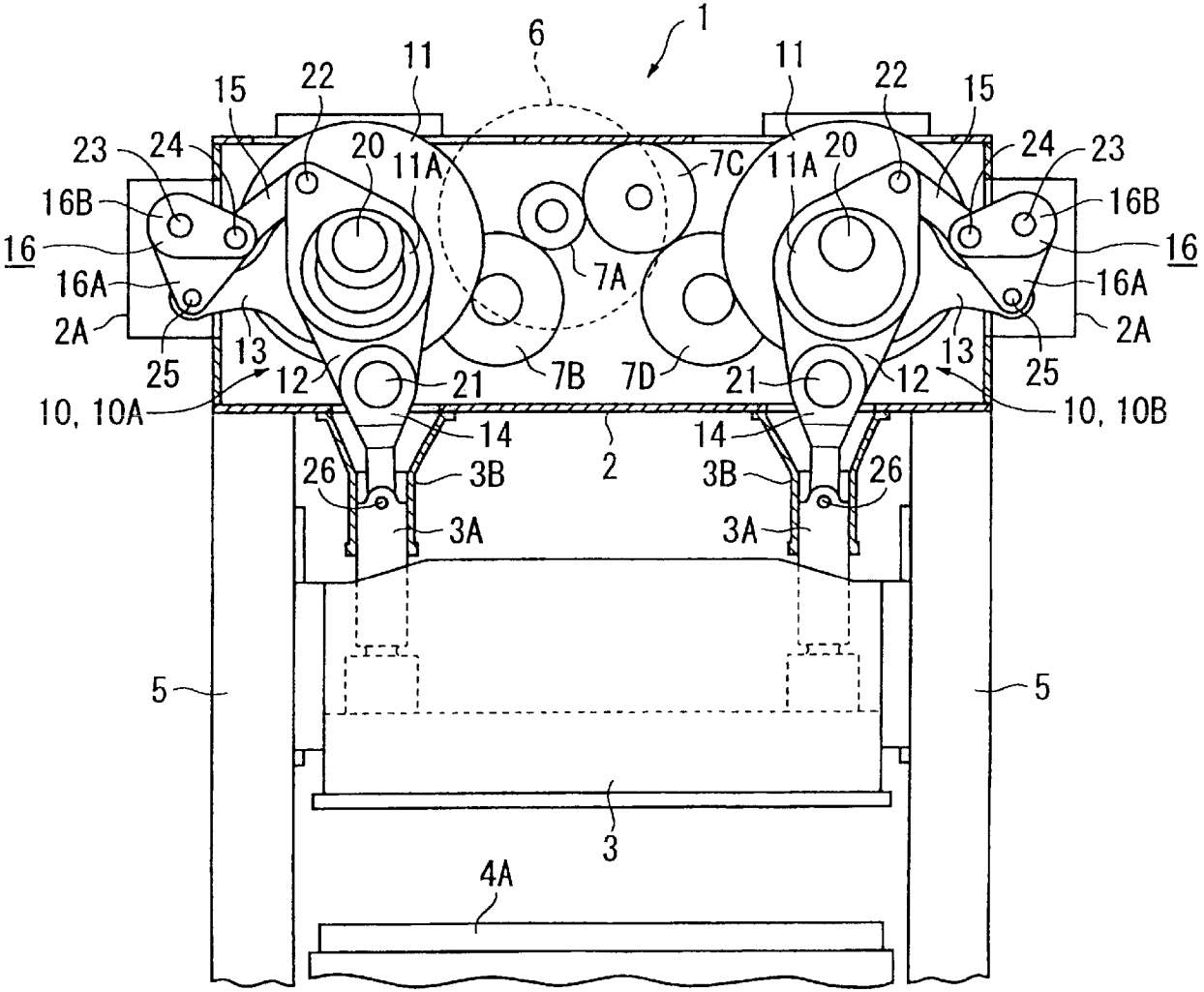
FIG. 1 is a front elevational view schematically showing a press applied with a slide drive unit according to an embodiment of the present invention.
Figure 2:
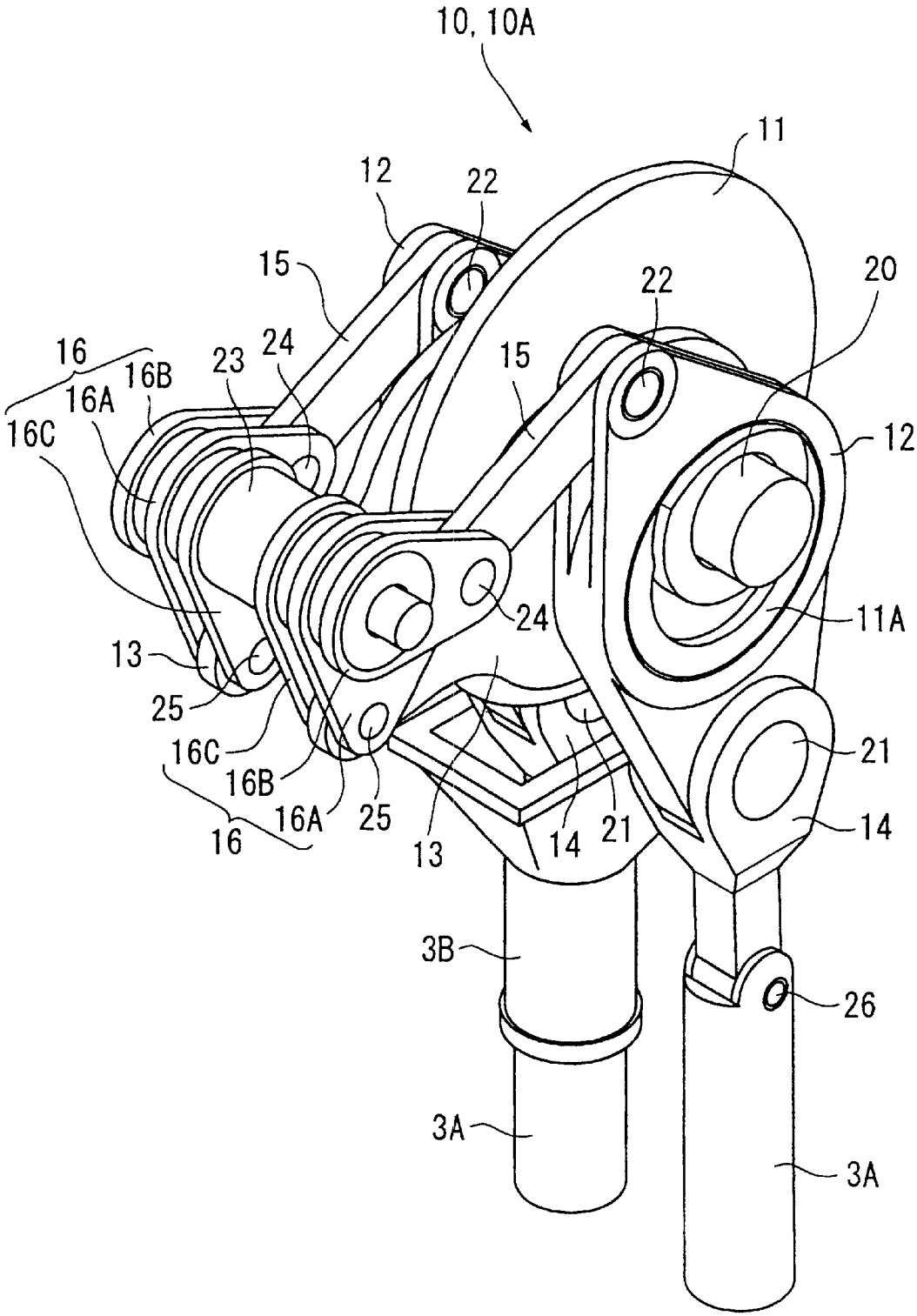
FIG. 2 is an entire perspective view showing the slide drive unit according to the aforesaid embodiment.
Figure 3:
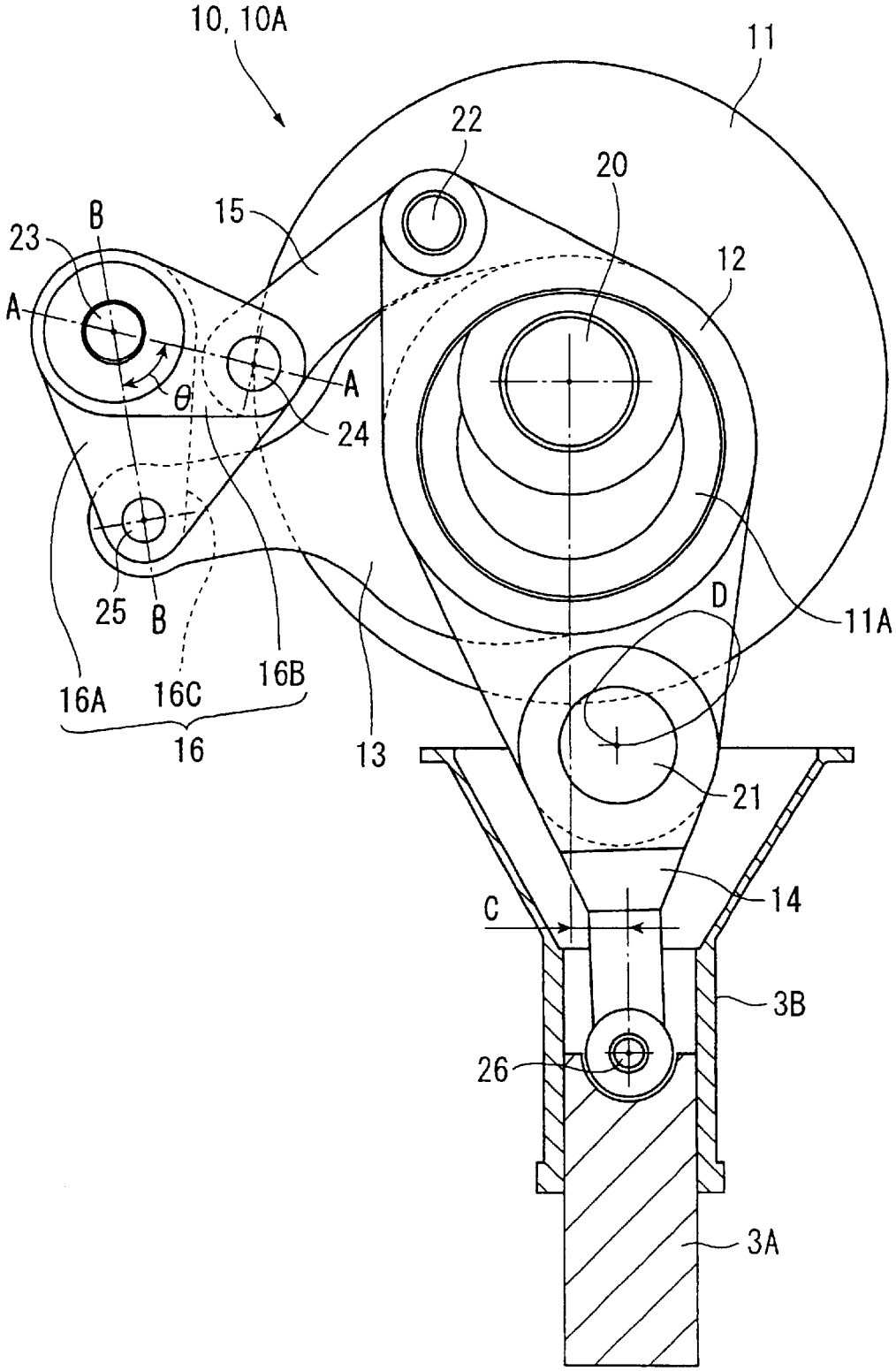
FIG. 3 is a front elevational view enlarging the slide drive unit according to the aforesaid embodiment when a slide is located at a bottom dead center.
Figure 4:
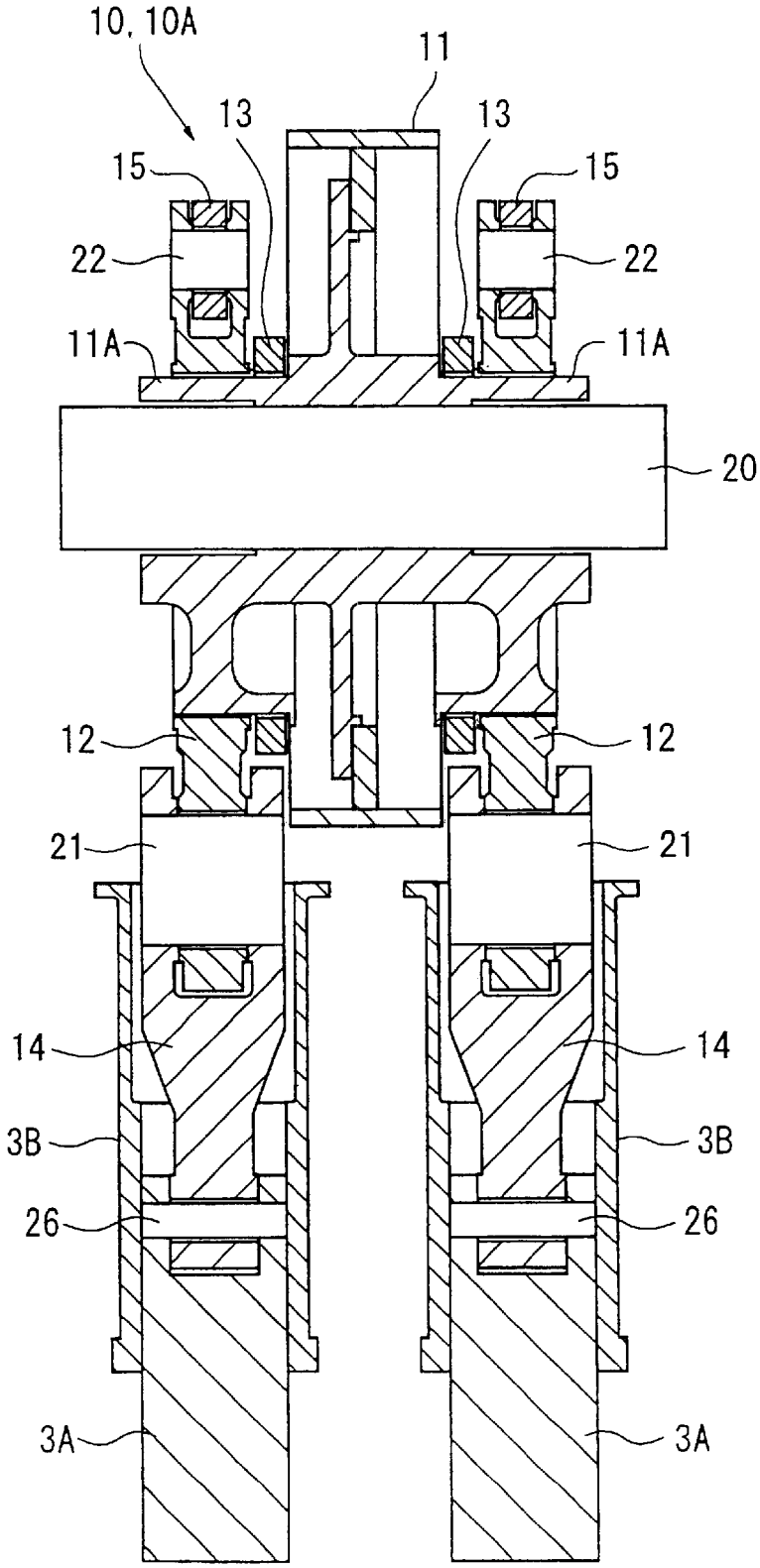
FIG. 4 is a cross section showing a slide drive unit according to the aforesaid embodiment.

FIG. 1 is a front elevational view showing a press 1 applied with a slide drive unit 10 (10A,10B) according to the present embodiment, FIG. 2 is an entire perspective view represented by a slide drive unit 10A, FIG. 3 is a front elevational view showing a slide drive unit 10A when a slide (not shown) is at a bottom dead center in an enlarged manner, and FIG. 4 is a cross section of the slide drive unit 10A.

In FIG. 1, the press 1 constitutes a part of a transfer press having a plurality of processing stations. The press 1 has a crown 2 accommodating two slide drive units 10 (10A,10B), a slide 3 connected to the slide drive unit 10 through a plunger 3A and attached with an upper die, a bed (not shown) provided with an accommodatable moving bolster 4A for a lower die to be attached, and an upright 5 for connecting the bed and the crown 2.

Incidentally, an ordinary bolster fixed to a bed may be used instead of the moving bolster 4A and the slide drive unit 10 and the slide 3 may be directly connected without using the plunger 3A.

The slide drive unit 10 of transfer press includes a slide drive unit 10A of greater capacity and a slide drive unit 10B of smaller capacity.

The slide drive unit 10A is driven by a drive force transferred from a main motor (not shown) through a flywheel 6 and gears 7A and 7B. The slide drive unit 10B is driven by drive force transferred from the main motor through the flywheel 6 and gears 7A, 7C and 7D, the main gears 11 of the slide drive unit 10A and 10B being rotated in mutually reverse manner.

Ordinarily, the slide drive unit 10A of greater capacity is located on an upstream in a direction for a workpiece to be conveyed (left side in FIG. 1), and the slide drive unit 10B of smaller capacity is located on a downstream in a direction for a workpiece to be conveyed (right side in FIG. 1) in approximately symmetric manner. However, the two slide drive units 10A and 10B may have the same capacity.

The slide drive unit 10A will be specifically described below. Since the slide drive unit 10B has the same structure and can be understood by the description of the slide drive unit 10A, the same reference number used for the components of the slide drive unit 10A will be attached to the slide drive unit 10B (FIG. 1), and detailed description will be omitted.

In FIGS. 1 to 5, the slide drive unit 10A is a device having so-called link mechanism, which includes a main gear 11 rotatably supported by a main gear supporting fixed shaft 20 and meshing with the gear 7A for the drive force from the main motor to be transferred.

Incidentally, the gear portion of the main gear 11 is omitted in FIGS. 2 and 3.

Eccentric drums 11A are respectively provided on both sides of the main gear 11 and a double-arm link 12 is rotatably fitted to an outer circumference of the eccentric drum 11A. Similarly, a single-arm link 13 is rotatably fitted to the outer circumference of the respective eccentric drums 11A to be located on an inside of the double-arm link 12. A connecting rod 14 is connected to a lower side of the respective double-arm link 12 through a connecting shaft 21 and an intermediate link 15 is connected to an upper end of the double-arm link 12 through a connecting shaft 22.

The intermediate link 15 and the single-arm link 13 are connected to a triaxial link 16 rotated around a fixed shaft 23 parallel to the main gear supporting fixed shaft 20 through connecting shafts 24 and 25. The fixed shaft 23 is located opposite to the slide drive unit 10B relative to the main gear supporting fixed shaft 20.

The plunger 3A is connected to the lower end of two connecting rods 14 through a connecting shaft 26 and a slide 3 (FIG. 1) is connected to the lower side of the respective plungers 3A. In other words, the press of the present embodiment is of a four-connecting-point type of which slide 3 is connected with total four plungers 3A of the respective slide drive units 10A and 10B. The respective plungers 3A reciprocally move inside a plunger guide 3B (only one is shown in FIG. 2) in perpendicular direction between the connecting rod 14 and the slide 3.

The triaxial link 16 includes a triangle first link member 16A to which the fixed shaft 23 and the connecting shafts 24 and 25 are inserted, an outside second link member 16B to which the fixed shaft 23 and the connecting shaft 24 are inserted, and an inside third link member 16C for the fixed shaft 23 and the connecting shaft 25 are inserted, a part of the triaxial link 16 being accommodated in a projecting part 2A projecting from a side of the crown 2 (FIG. 1).

In the triaxial link 16, angle θ formed by a straight line A connecting respective centers of the fixed shaft 23 and the connecting shaft 24 and a straight line B connecting respective centers of the fixed shaft 23 and the connecting shaft 25 is an acute angle smaller than ninety degrees. Especially, when the slide 3 is at the bottom dead center thereof, the shaft center of the connecting shaft 24 is located below the shaft center of the fixed shaft 23 and on the side of the main gear supporting fixed shaft 20, and the shaft center of the connecting shaft 25 is located below the shaft center of the fixed shaft 23 and on the side of the main gear supporting fixed shaft 20 and opposite to the main gear supporting fixed shaft 20 relative to the connecting shaft 24 (on the side of the fixed shaft 23).

The shaft center of the connecting shaft 26 connecting the connecting rod 14 and the plunger 3A is horizontally shifted relative to the shaft center of the main gear supporting fixed shaft 20 by an offset C and is located opposite to the fixed shaft 23. The offset C is set so that a locus D of a shaft center of the connecting shaft 21 connecting the double-arm link 12 and the connecting rod 14 is always drawn on one side relative to the shaft center of the main gear supporting fixed shaft 20, i.e. on the opposite side of the fixed shaft 23. Accordingly, the force applied to the single-arm link and the intermediate link 15 is 5 to 10% of connecting point capacity (tonnage) and is restricted only to compressive force.

Figure 5:
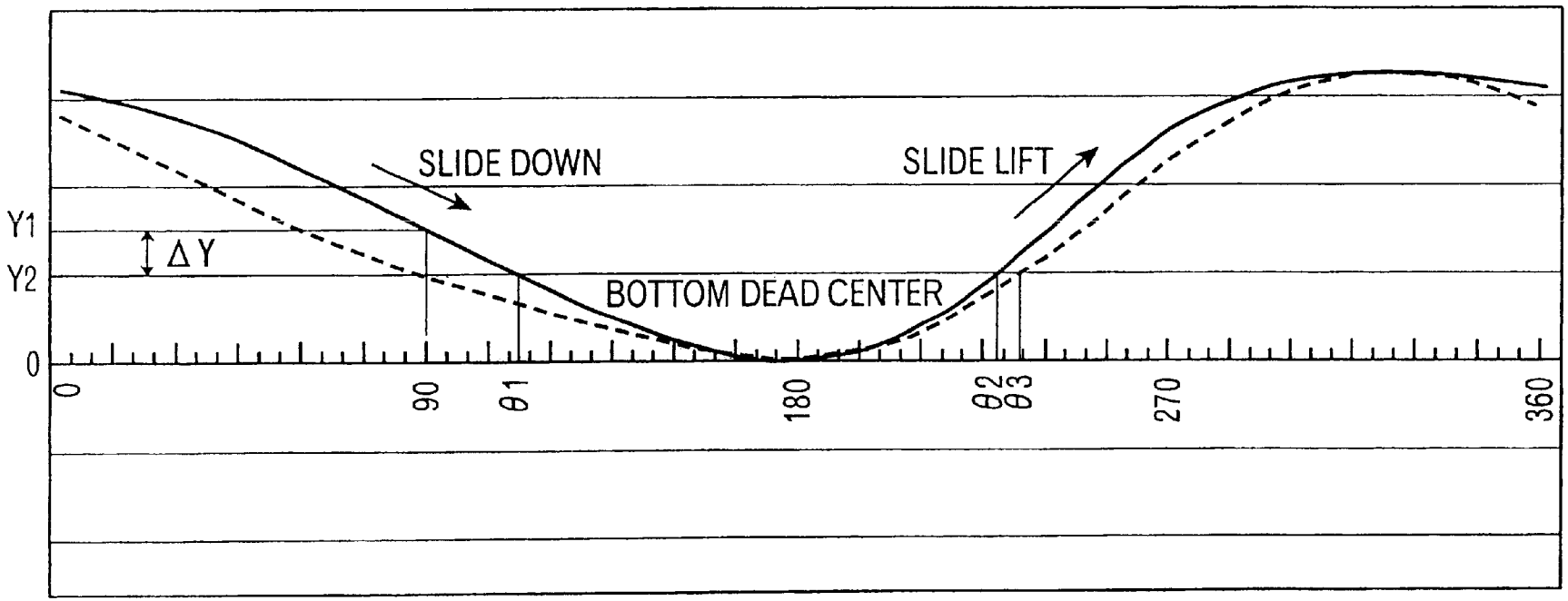
FIG. 5 is a graph showing a slide motion of the slide drive unit of the aforesaid embodiment.

The slide motion of the slide drive unit 10 arranged above is shown in solid line in FIG. 5. In FIG. 5, horizontal axis represents crank angle and vertical axis represents the height from the bottom dead center of the slide 3. The dotted line represents the slide motion of the conventional slide drive unit described in the background art section.

As shown in FIG. 5, according to the slide drive unit 10 of the present embodiment, the slide position at the crank angle of ninety degrees in lowering the slide 3 is Y1. On the contrary, the slide position of the conventional slide unit is Y2, showing that the position is higher in the slide drive unit 10 by ΔY at the same crank angle, which also holds true from the start of lowering to the bottom dead center. Further, the solid line is above the dotted line after the slide 3 passes the bottom dead center and starts moving upward, which shows that the slide position is higher at the same crank angle than the conventional arrangement.

When the slide position is higher for the same crank angle, the time capable for being reserved for conveyance of workpiece can be lengthened. For instance, when the height necessary for conveying the workpiece is assumed Y2, though the workpiece cannot be conveyed at the crank angle ninety degrees in the conventional slide drive unit in lowering the slide, the workpiece can be conveyed until the crank is rotated to the angle θ1 in the slide drive unit of the present embodiment. Further, in raising the slide, though the workpiece cannot be conveyed until the crank angle reaches θ3 in the conventional slide drive unit, the workpiece can be conveyed from the crank angle θ2 in the slide drive unit of the present embodiment. Accordingly, the slide drive unit of the present embodiment can lengthen the time reserved for conveyance of the workpiece as compared to the conventional slide drive unit.

According to the present embodiment, following advantages can be obtained.

(1) Since the angle θ formed by the straight lines A and B connecting the fixed shaft 23 and the two connecting shafts 24 and 25 of the triaxial link 16 is set acute in the slide drive unit 10, the position of the slide 3 for the same crank angle is higher than the conventional arrangement until the slide 3 moves from the top dead center to the bottom dead center, so that the time for the slide 3 to reach a predetermined position, i.e. the time for the slide 3 to be lowered to a height where conveyance of the workpiece becomes difficult, becomes longer than the conventional arrangement at the same SPM, thereby allowing the transfer feeder to be driven with sufficient time. Accordingly, even when SPM of the press is raised to improve the productivity, the workpiece can be securely conveyed without causing great acceleration and deceleration on the transfer bar or strictly limiting the design of die configuration.

(2) Further, as shown in FIG. 5, since the slide 3 is raised earlier than the conventional arrangement after raising the slide 3, the workpiece can be transferred from a processing station at earlier timing. Accordingly, the transfer feeder can be driven with sufficient time, and the transfer feeder can easily follow increase in SPM of the press 1, productivity can be improved.

(3) Since the shaft center of the connecting shaft 26 connecting the connecting rod 14 and the plunger 3A of the slide drive unit 10 is shifted by offset C relative to the shaft center of the main gear supporting fixed shaft 20 and the locus D of the shaft center of the connecting shaft 21 connecting the double-arm link 12 and the connecting rod 14 is always drawn on the side opposite to the fixed shaft 23 relative to the shaft center of the main gear supporting fixed shaft 20, only compressive force can be constantly applied to the single-arm link 13 and the intermediate link 15, thereby preventing tension force and compressive force from being alternately applied. Accordingly, shaky movement of the single-arm link 13 and the intermediate link 15 is unlikely while driving the slide drive unit 10, thereby obtaining highly accurate molding.

(4) Since the compressive force applied to the single-arm link 13 and the intermediate link 15 can be substantially reduced by the arrangement of (3), the thickness of the single-arm link 13 and the intermediate link 15 can be reduced, thereby reducing the size and weight of the link member.

(5) Since the angle θ formed by the straight lines A and B of the triaxial link 16 is acute, the dimension between the connecting shafts 24 and 25 can be reduced, so that vertical dimension of the entire triaxial link 16 can be reduced, thereby further enhancing reduction in size and weight of the link member.

Since the size of the triaxial link is reduced, only the projecting part 2A is provided on a side of the crown 2 and the length of the body of the crown 2 is not necessarily be extended on the entire height as in the conventional link mechanism, so that the weight of the body of the crown 2 can be substantially reduced.

Incidentally, the scope of the present invention is not restricted to the above-described embodiments.

For instance, though the shaft center of the connecting shaft 26 is shifted by offset C relative to the shaft center of the main gear supporting fixed shaft 20, the offset may be zero and there may be no shift between the shaft centers in the present invention. However, since the above advantages of (3) and (4) can be obtained by setting the offset C, the shaft centers may preferably be offset.

In the triaxial link 16 of the present embodiment, though the shaft center of the connecting shaft 24 is below the shaft center of the fixed shaft 23 and on the side of the main gear supporting fixed shaft 20 and the shaft center of the connecting shaft 25 is below the shaft center of the fixed shaft 23 and on the side of the main gear supporting fixed shaft 20 and on the side of the fixed shaft 23 relative to the connecting shaft 24, the connecting shaft 24 may be located approximately at the same height as the fixed shaft 23 or may be located slightly above the fixed shaft 23. In other words, the present invention only requires that the angle θ formed by the straight lines A and B connecting the fixed shaft 23 and the connecting shafts 24 and 25 is acute and the positional relationship between the fixed shaft 23 and the connecting shafts 24 and 25 may be changed in implementing the present invention.

Though the press 1 of the above-described embodiment is four-connecting-point type which includes two slide drive units 10 (10A and 10B) and four plungers 3A, the motion or number of the connecting-points is not limited to the above-described embodiment but may be set as desired considering the capacity of the press to which the present invention is applied. However, since the respective slide drive units 10A and 10B are approximately symmetrically located as in the present embodiment, sufficient durability can be obtained in a transfer press to which biased load is easily applied in processing.

Further, though the slide position at the same crank angle is higher than the conventional arrangement not only in lowering the slide 3 but also in raising the slide 3, approximately the same slide motion may be conducted in raising the slide 3 in the present invention.

The configuration etc. of the respective link member constituting the slide drive unit may be designed at will in implementing the present invention, which is not restricted to the above specific embodiments.

What is claimed is:

1. A slide drive unit of a press, comprising:

a main gear (11);

a main gear supporting fixed shaft (20) for the main gear to be supported;

a double-arm link (12) and a single-arm link (13) rotatably fitted to an eccentric drum (11A) integrated with the main gear (11) of which a rotation center is eccentric relative to the main gear supporting fixed shaft;

a connecting rod (14) connected to one end of the double-arm link (12);

an intermediate link (15) connected to the other end of the double-arm link (12); and a triaxial link (16) rotated around a fixed shaft (23) parallel to the main gear supporting fixed shaft (20), the triaxial link being connected with the intermediate link (15) and the single-arm link (13), wherein an angle (θ) formed by a straight line (A) connecting a connecting shaft (24) of the intermediate link (15) with the fixed shaft (23) of the triaxial link (16) and another straight line (B) connecting a connecting shaft (25) of the single-arm link (13) and the triaxial link (16) and the fixed shaft (23) of the triaxial link (16) is acute.

2. The slide drive unit of a press according to claim 1, wherein one end of the connecting rod (14) is connected to the double-arm link (12) and the other end of the connecting rod (14) is connected to a slide (3) or a plunger (3A) perpendicularly reciprocating between the connecting rod (14) and the slide (3), and wherein horizontal position of a center of a shaft (26) connecting the other end of the connecting rod is shifted to a side opposite to the fixed shaft (23) of the triaxial link (16) relative to a shaft center of the main gear supporting fixed shaft (20).

* * * * *